US005995021A

United States Patent [19]

Kogure

[11] Patent Number: 5,995,021

[45] **Date of Patent: *Nov. 30, 1999**

[54] COMMUNICATOR FOR FIELD INSTRUMENTS AND METHOD FOR SUPPLYING POWER TO THIS COMMUNICATOR

[75] Inventor: Makoto Kogure, Katsuta, Japan

[73] Assignee: Hitachi, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/504,800

[22] Filed: Jul. 20, 1995

Related U.S. Application Data

[63] Continuation of application No. 07/594,983, Oct. 10, 1990, abandoned.

[30] Foreign Application Priority Data

Oct. 13, 1989 [JP] Japan ..... 1-267863

[51] Int. Cl.[6] ..... G08B 23/00

[52] U.S. Cl. ..... 340/870.02; 340/825.05; 340/825.5; 340/870.16

[58] Field of Search ..... 340/870.16, 870.11, 340/870.07, 825.05, 825.06, 825.5, 310.01, 870.02

[56] References Cited

U.S. PATENT DOCUMENTS

| | | | |
|---|---|---|---|
| 4,387,434 | 6/1983 | Moncief, Jr. et al. | 340/870.16 |
| 4,520,488 | 5/1985 | Houvig et al. | 340/310.01 |
| 4,623,871 | 11/1986 | Akano | 340/310.01 |
| 4,737,787 | 4/1988 | Ito et al. | 340/870.18 |
| 4,797,669 | 1/1989 | McGowan, III et al. | 340/870.16 |
| 4,988,990 | 1/1991 | Warrior | 340/870.16 |
| 5,122,794 | 6/1992 | Warrior | 340/825.05 |
| 5,184,121 | 2/1993 | Kogure et al. | 340/825.5 |

FOREIGN PATENT DOCUMENTS

| | | |
|---|---|---|
| 0212897A3 | 8/1986 | European Pat. Off. . |
| 02213767A2 | 8/1986 | European Pat. Off. . |
| 0219120A2 | 10/1986 | European Pat. Off. . |
| 0244808 | 5/1987 | European Pat. Off. . |

*Primary Examiner*—Michael Horabik
*Assistant Examiner*—Timothy Edwards, Jr.
*Attorney, Agent, or Firm*—Antonelli, Terry, Stout & Kraus, LLP

[57] ABSTRACT

A communicator for field instruments connected to a transmission line for transmitting electric signals from the field instruments to a host instrument. The communicator operates on electric power fed from an external power supply over the transmission line. The external power supply is arranged in the transmission line. Electric current consumed by the transmission line is set to a constant value.

11 Claims, 5 Drawing Sheets

COMMUNICATOR FOR FIELD INSTRUMENTS AND METHOD FOR SUPPLYING POWER TO THIS COMMUNICATOR

This application is a continuation of application Ser. No. 07/594,983, filed on Oct. 10, 1990, now abandoned.

BACKGROUND OF THE INVENTION

1. Field of the Invention

The present invention relates to a communicator for field instruments which is connected to a transmission line which connects the field instruments to a host instrument in order to perform communication between the field instruments and the host instrument. The invention also relates to a method of supplying power to the communicator.

2. Description of the Related Art

Instruments known as field instruments have a great variety of sensors incorporated in them, and measure physical quantities, such as pressure, temperature, and flow rate in various plants. They transmit such physical measurements to a host instrument over a transmission line, after having converted the physical quantities into electric signals. The transmission of these electric signals has been standardized. The field instruments output analog current signals of 4–20 mA to the transmission line, and the host instrument receives the analog current signals. The analog signals are transmitted from the field instruments to the host instrument in a one-way communication.

Because of improvements in the technique of manufacturing semiconductor ICs, field instruments incorporating microprocessors have been developed and put into practical use in recent years. The field instrument performs two-way communication in digital signals, rather than one-way communication in analog signals as over the above-mentioned transmission line, and is capable of performing processes such as range setting and self-diagnosis of the field instrument even from a remote place. The field instrument also communicates with a communicator exclusively in digital signals, this communicator being connected to any place along the transmission line. A device of this type is disclosed, for example, in Japanese Patent Laid-Open No. 59-201535.

In the conventional example mentioned above, as a method of transmitting signals over the transmission line, digital signals are carried on analog signals for simultaneous communication. In addition to this method, there is a method in which analog signals are switched over to digital signals for communication. There is also a method in which communication is performed solely in digital signals.

In these conventional examples, the communicator has a built-in power supply such as a battery, and is constructed so as to operate all the built-in circuits on the electric power fed from the built-in power supply. For this reason, it is required to carry out maintenance, such as replacing or charging the built-in battery, after the built-in battery has been used for a predetermined period.

The above-described conventional art, however, does not take into consideration where the communicator is continuously used for a long period of time for trouble-shooting the field instrument or the like. In other words, there is a problem in that since the service time of the power supply incorporated in the communicator is limited, it is impossible to continuously monitor values, such as output values and internal status of the field instrument for prolonged periods.

Furthermore, the communicator is not always utilized in an instrument room, but may also be connected to any place along the transmission line for outdoor use. In such a case, when the capacity of the built-in power supply runs out during its service, the built-in power supply must be replaced or charged. This leads to a problem in that maintenance, such as replacing or charging the built-in power supply, becomes troublesome.

SUMMARY OF THE INVENTION

An object of the present invention is therefore to provide a communicator for field instruments which can be continuously used for prolonged periods, and which reduces the frequency of maintenance, and to provide a method of supplying power to this communicator.

In order to achieve the foregoing object, the present invention provides a communicator for field instruments which is connected to a transmission line for transmitting electric signals from the field instruments to a host instrument, and which operates on electric power fed from an external power supply over the transmission line.

The invention further provides a communicator for field instruments which is connected to a two-wired transmission line for transmitting electric signals from the field instruments to a host instrument, and which operates on electric power fed from an external power supply over the transmission line.

Furthermore, the invention provides a communicator for field instruments which is connected to the ends of a voltage drop element arranged in series in a transmission line which connects the field instruments to a host instrument, and the communicator operates on electric power fed from an external power supply over the transmission line.

Moreover, the invention provides a communicator for field instruments which is connected in series to any place along the transmission loop of a transmission line which connects the field instruments to a host instrument, and the communicator operates on electric power fed from an external power supply over the transmission line.

In addition, the invention provides a communicator for field instruments connected to a transmission line which connects a plurality of field instruments connected in a parallel manner to a host instrument, and the communicator operates on electric power fed from an external power supply over the transmission line.

According to the present invention, there is provided a communicator for field instruments connected to a two-wired transmission line which connects a plurality of field instruments connected in a parallel manner to a host instrument, wherein the communicator operates on electric power fed from an external power supply over the two-wired transmission line.

According to the invention, there is also provided a communicator for field instruments connected to the ends of a voltage drop element when the voltage drop element is arranged in series in a transmission line which connects a plurality of field instruments connected in a parallel manner to a host instrument, and the communicator operates on electric power fed from an external power supply over the transmission line.

According to the invention, there is further provided a communicator for field instruments which is connected in series to any place along the transmission loop of a transmission line which connects a plurality of field instruments connected in a parallel manner to a host instrument, and the communicator operates on electric power fed from an external power supply over the transmission line.

The present invention provides a plant monitoring system including a field instrument for measuring physical quantities of a plant; a host instrument for receiving detected signals from the field instrument over a transmission line; a communicator for performing communication between the field instrument and the host instrument; a host controller for controlling the plant based on signals from the host instrument; and a power supply arranged in the transmission line so as to operate the communicator.

The present invention further provides a plant monitoring system connected in parallel to a commonly used transmission line, including a plurality of field instruments for measuring physical quantities of a plant; a host instrument for receiving detected signals from the field instruments over the transmission line; a communicator for performing communication between the field instruments and the host instrument; a host controller for controlling the plant based on signals from the host instrument; and a power supply arranged in the transmission line so as to operate the communicator.

Moreover, the invention provides a method of supplying power to a communicator for field instruments, wherein the communicator is connected to any place along a transmission line over which electric signals are transmitted from the field instrument to a host instrument, and when communication is performed among the field instruments, the host instrument, and the communicator, electric power to operate the communicator is fed from the transmission line.

The field instruments connected to the transmission line are fed with electric power from the external power supply, and are operated on the electric power. For this reason, a constant amount of electric current always passes over the transmission line. When the field instruments communicate with the host instrument, they alter the electric current passing over the transmission line in order to transmit digital signals. This alteration is performed by altering the electric current consumed by the field instruments. The host instrument detects not only alterations in the voltage between the ends of a load resistor connected in series to the transmission line, but also alterations in the voltage between the ends of the transmission line in order to receive the digital signals. This detection is performed by altering the electric current passing over the transmission line.

When the communicator constructed above is connected to the transmission line, the absolute value of the electric current passing over the transmission line remains altered. If, however, the electric current which the communicator consumes is constant, an alteration in the electric current passing over the transmission line occurs only once. The field instruments connected to the transmission line will not thus erroneously receive digital signals due to that alteration.

When the communicator is also engaged in communication, it operates in the same manner as when the field instruments are engaged in communication, so that there is no problem in communication.

Moreover, when the voltage drop element is connected in series to the transmission line, and the communicator is then connected to the ends of the voltage drop element, a part of the electric current passing over the transmission line flows to the communicator, thereby allowing the communicator to operate.

In addition, even when the communicator is connected in series to any place along the transmission loop, the electric current passing over the transmission loop flows to the communicator, thereby also allowing the communicator to operate.

DESCRIPTION OF THE PREFERRED EMBODIMENTS

An embodiment of the present invention will now be described with reference to the drawings.

Figure 1:
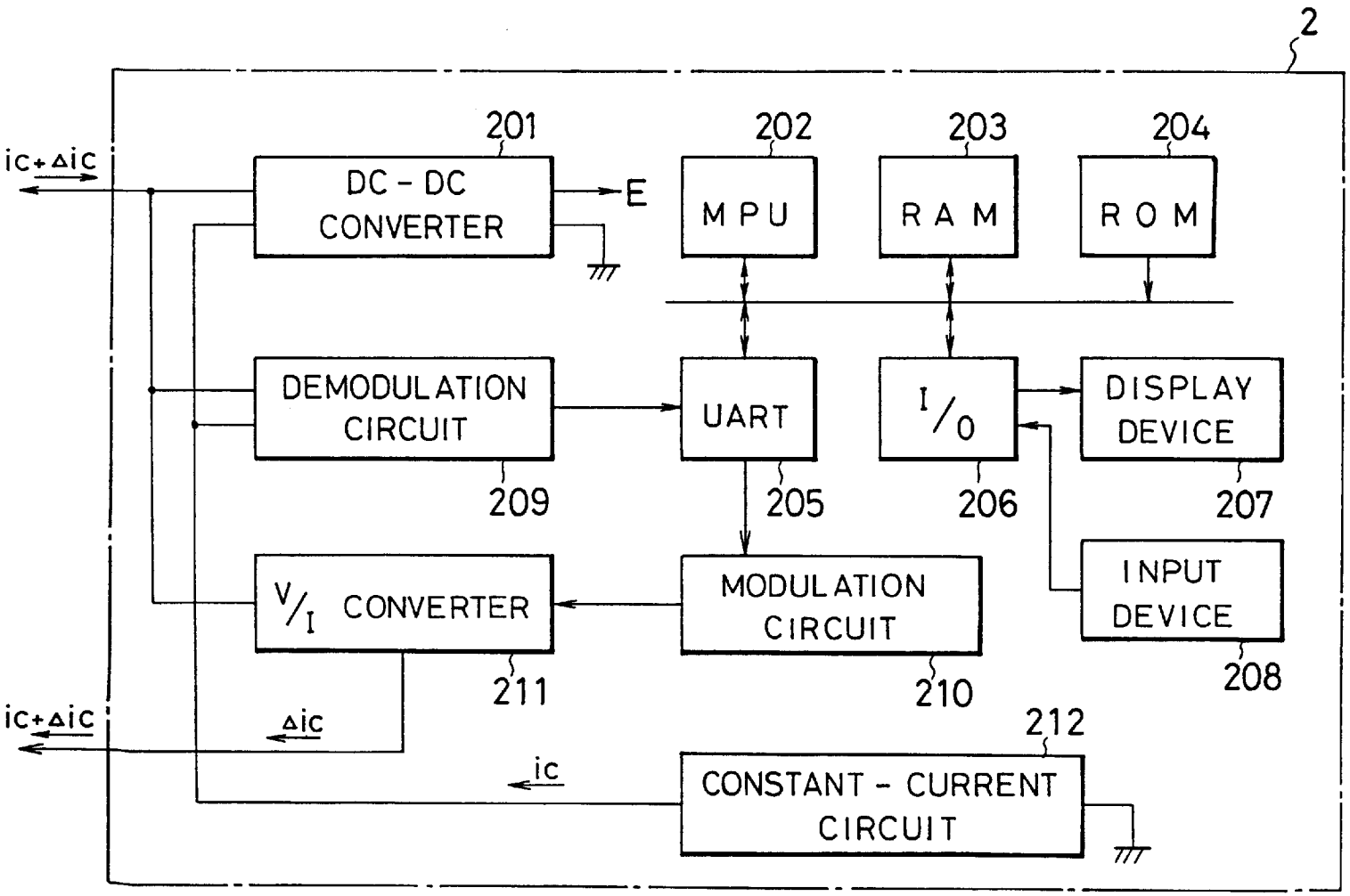
FIG. 1 is an inner block diagram showing an embodiment of a communicator according to the present invention.
Figure 2:
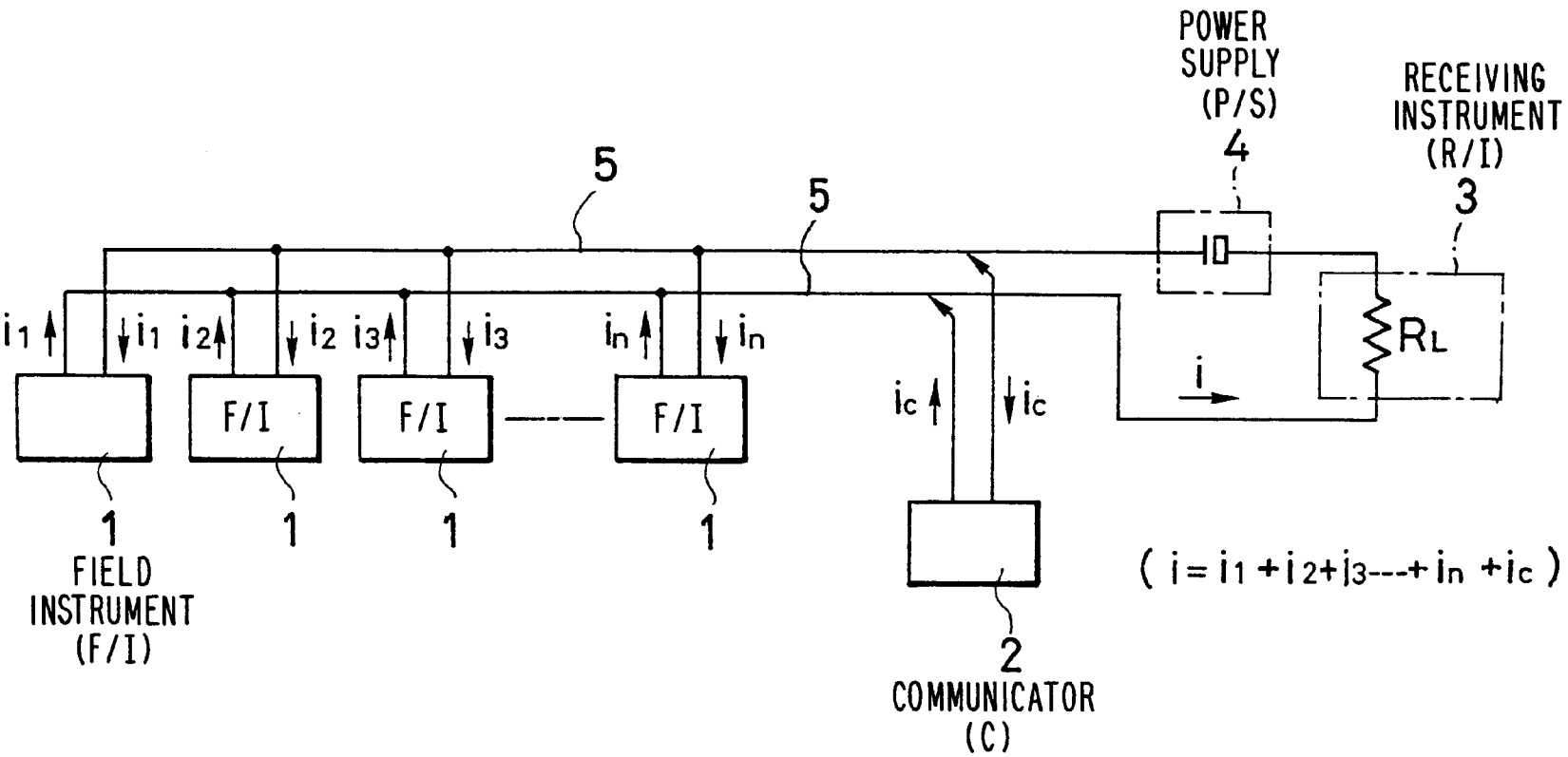
FIG. 2 is a view showing the configuration of a communication system unit to which the communicator illustrated in FIG. 1 is connected.

FIG. 1 is an inner block diagram of a communicator according to the present invention, and FIG. 2 is a view showing the configuration of a communication system unit to which the communicator shown in FIG. 1 is connected. In FIG. 2, field instruments 1 measure, by means of a built-in sensor, physical quantities such as pressure, flow rate, and temperature in various plants. The field instruments 1 operate on the electric power fed from an external power supply 4 arranged in a transmission line 5, and output signals corresponding to the physical quantities. This output is performed by a communication means over the transmission line 5. The communicator 2 has a communication function incorporated in it, and is connected between the field instruments 1 along the transmission line 5 and a host receiving instrument 3 as well as the external power supply 4 in order to communicate with the field instruments 1 in the form of digital signals. The communicator 2 performs processes, such as monitoring and calibrating I/O signals to and from the field instruments 1. The host receiving instrument 3 has a communication function incorporated in it, and receives the physical quantity data which the field instruments 1 measure so as to send the physical quantity data to an unillustrated host controller. This reception is carried out by a communication means over the transmission line 5. The host receiving instrument 3 also communicates with the field instruments 1 to perform processes, such as self-diagnosis and modification to a measurement range. The communicator 2 is detachably attached to any position along the transmission line 5, and operates, in the same manner as with the field instruments 1, on the electric power fed from the external power supply 4 over the transmission line 5. When the communicator 2 is connected, the electric current "i" passing over the transmission line 5 is the sum of the electric current ($i_1+i_2+i_3+ \ldots i_n$) which the field instruments 1 consume and the electric current ($i_c$) which the communicator 2 consumes. When there is no communication performed, this electric current "i" assumes a constant value. For the above reason, when there is no communication performed, the voltage between the ends of the transmission line 5 is the voltage at which the amount proportional to voltage drop ($i \times R_L$) in the host receiving instrument 3 is subtracted from the voltage of the external power supply 4. The voltage between the ends of the transmission line 5 thus becomes a constant value. To perform communication, the field instruments 1 and the communicator 2 alter, in correspondence to communication data, the respective electric current consumption mentioned above, thereby altering the electric current "i" passing over the transmission line 5. Since the voltage between the ends of the transmission line 5 is accordingly altered, the respective devices receive the communication data by detecting alterations in the voltage between the ends of the transmission line 5. The host receiving instrument 3 transmits signals by altering the impedance in a load resistor $R_L$, and detects alterations in the electric current "i" passing through the load resistor $R_L$ in order to receive signals. When the communicator 2 is removed from the transmission line 5, the electric current passing over the transmission line 5 is altered. This alteration is, however, not recognized as communication data, so that it does not affect the communication system, so long as the communicator 2 is not removed during communication. Should the communicator 2 be removed from the transmission line 5 even during communication, communication data may be erroneously received. Effect on electric current values, however, can be prevented by carrying out a process such as a retry process, because the communication system is affected only the moment at which the communicator 2 is removed.

The detailed operation of the communicator 2 will be described hereinafter with reference to FIG. 1. Inside the communicator 2, a microprocessor (MPU) 202 controls the entire operation of the communicator 2 by means of programs stored in a ROM 204. An input device 208 is composed of a keyboard or the like. When the user inputs information using the keys defined, the input information is transmitted to the microprocessor (MPU) 202 via an I/O interface 206. The microprocessor (MPU) 202 outputs as required a command for communication to a transmitting and receiving circuit (UART) 205, and this command is transmitted to a V/I converter through a modulation circuit 210. The V/I converter sends an electric current corresponding to an input signal to the transmission line 5, and this input signal becomes a transmission signal. If the output signal from the modulation circuit 210 is the same amplitude wave, sine wave or the like in the positive and negative directions, even during communication the electric current which the communicator 2 consumes assumes an approximately constant value with a momentary alteration in the electric current. A response signal from the field instruments 1, which have received the transmission signal, is demodulated in the form of digital signals due to the fact that a demodulation circuit 209 detects alterations in the voltage between the ends of the transmission line 5. The response signal is then sent to the microprocessor 202 through the transmitting and receiving circuit (UART) 205. The microprocessor 202 displays the response signal, together with the data stored in a RAM 203, on a display device 207 via the I/O interface 206.

Those inner circuits in the communicator 2 operate on the electric power fed from a DC-DC converter 201 over the transmission line 5. At the voltage between the ends of the transmission 5, the DC-DC converter 201 generates voltage (E) capable of operating the respective circuits mentioned above, and feeds the voltage (E) to all the circuits. A constant-current circuit 212 operates so that the electric current, consumed by the inner circuits except the electric current which the V/I converter in the communicator 2 outputs, may always assume a constant value (ic). For this reason, no alteration in the electric current values in any except the electric current which is output as a transmitting signal during communication, occurs in the entire communicator 2. When the communicator 2 is not engaged in communication, the communication of the other devices in the transmission line 5 is therefore not affected.

Figure 3:
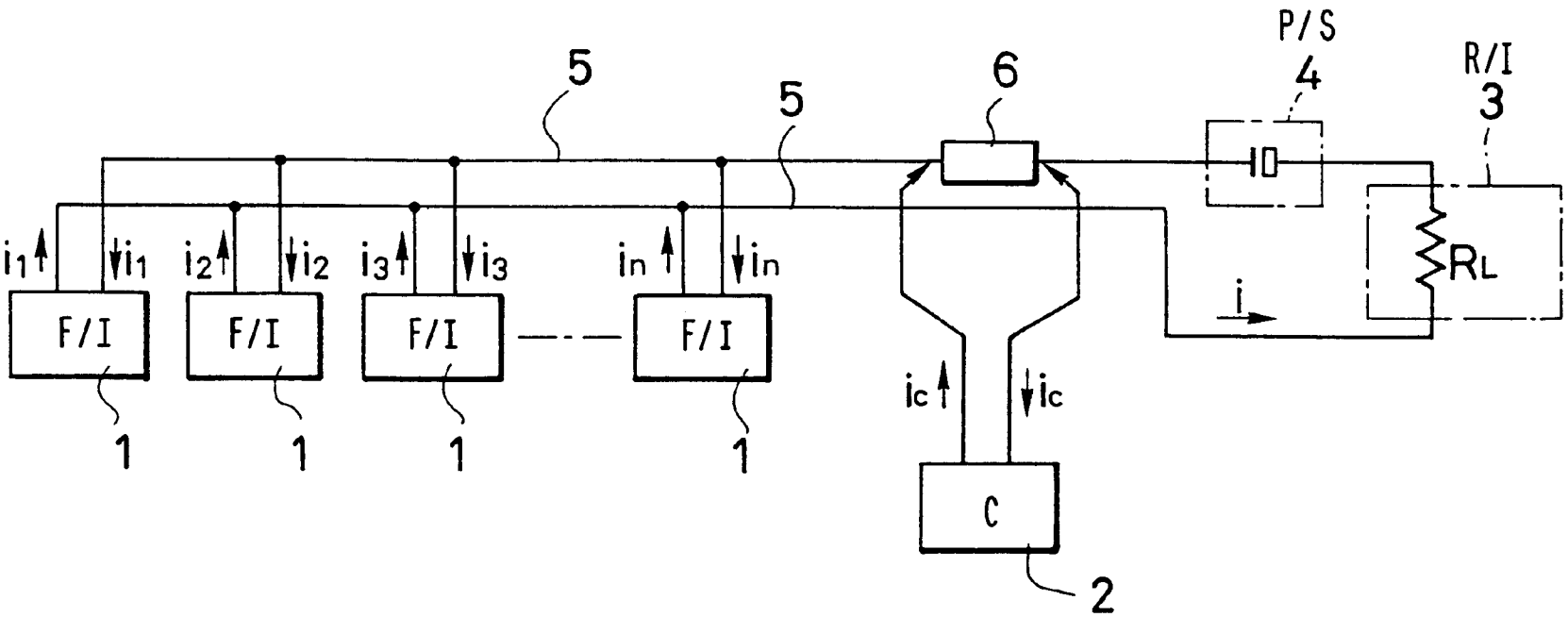
FIG. 3 is a view showing the configuration of another communication system unit to which the communicator is connected.

The communicator 2 shown in FIG. 1 may also be used in the system configuration shown in FIG. 3, other than in the system configuration illustrated in FIG. 2. In FIG. 3, the communicator 2 is connected to the ends of a voltage drop element 6. The inner circuits of the communicator 2 operate on part of the electric current "i" passing over the transmission line 5.

With such a configuration, it is possible to minimize communication errors when the communicator 2 is connected to the ends of the voltage drop element 6.

Figure 4:
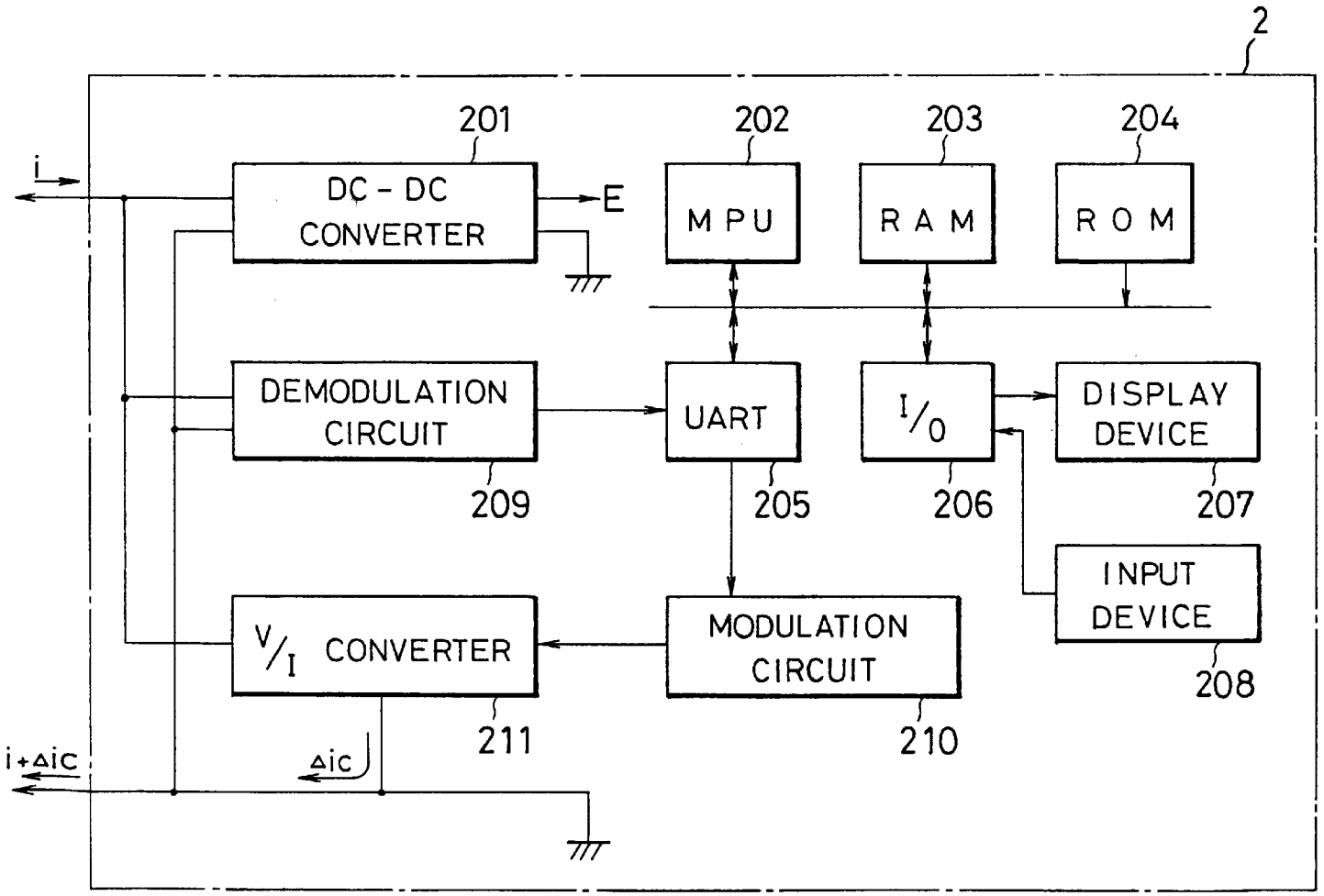
FIG. 4 is an inner block diagram showing another embodiment of the communicator according to the present invention.
Figure 5:
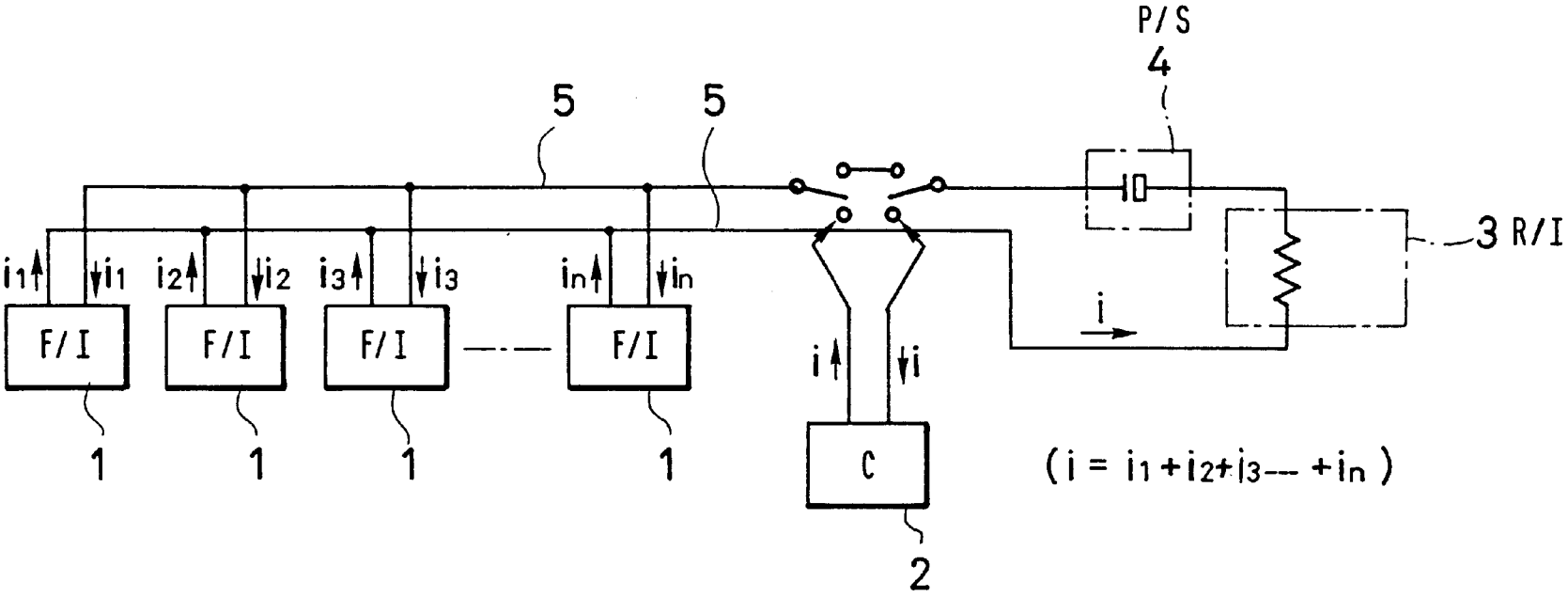
FIG. 5 is a view illustrating the configuration of a communication system unit to which the communicator shown in FIG. 4 is connected.

FIG. 4 illustrates another embodiment of the present invention, and FIG. 5 illustrates an example of the system configuration of the embodiment in FIG. 4. In FIG. 5, the communicator 2 is connected in series to the loop of the transmission line 5, and the inner circuits of the communicator 2 operate on part of the electric current "i" passing over the transmission line 5. When the communicator 2 is connected to the transmission line 5, because it is arranged as a part of the loop of the transmission line 5, a voltage drop occurs in the voltage between the ends of the transmission line 5. However, when the circuits of the communicator 2 are arranged so as to operate by a constant-voltage input so that the voltage drop value may be kept constant, communication is not affected. For the above reason, in the communicator 2 shown in FIG. 4, the voltage on the input side of the DC-DC converter 201 must remain constant. The operation inside the communicator 2 of FIG. 4 is the same as that described in FIG. 1. Since the communicator 2 is connected in series to the transmission line 5, keeping the above-mentioned voltage drop at a constant value renders a constant-current circuit unnecessary.

In this embodiment, when the communicator 2 is attached to or removed from the transmission line 5, it is possible to prevent communication on the part of other devices using the same transmission line 5 from being affected.

Though the two-wired transmission line has been described in those embodiments, the present invention may also be applied to a four-wired transmission line.

As has been explained, according to the present invention, since the communicator does not have a built-in power supply and may be connected to the transmission line, maintenance, such as replacement or charging of the built-in battery, can be omitted. It is also possible to continuously utilize the communicator for prolonged periods, because temporary built-in power supplies such as a battery are no longer necessary.

Furthermore, in a plant monitoring system to which the field communicator of the present invention is installed, even when the host controller is removed, it is possible to confirm the operation of the communicator by using an external power supply in the transmission line.

What is claimed is:

1. A field instrument system comprising:

a plurality of field instruments;

a host instrument;

a power source;

a transmission line, at least a portion of which forms a current loop for connecting said field instruments, said host instrument, and said power source; and a communicator for communicating with said field instruments to monitor their status and communicating with said host instrument to inform said host instrument of the status of said field instruments;

wherein said communicator communicates with said field instruments and said host instrument using digital electrical signals, wherein said transmission line carries said digital electrical signals among said field instruments, said host instrument, and said communicator, wherein said communicator is detachably connected to said transmission line, wherein electric power for operating said communicator is derived from said current loop, and wherein said field instruments are connected in parallel with one another along said current loop and transmit a measured physical quantity to said host instrument via said transmission line in digital signals.

2. The field instrument of claim 1, wherein said communicator includes a constant current circuit which controls the electric power derived from said current loop at a constant value, and wherein said constant current circuit is connected to said field instruments in parallel.

3. The field instrument system of claim 1, wherein said communicator includes a constant current circuit which controls electric power derived from said current loop at a constant value, said constant current circuit is connected in parallel with a voltage drop element which is connected in series with said current loop.

4. A communicator for use in a field instrument system which includes a plurality of field instruments, a host instrument, a power source, a transmission line forming a current loop connecting said field instruments, said host instrument and said power source, and carrying digital electrical signals, said field instruments being connected in parallel with one another along said current loop, said communicator comprising:

a pair of terminals connected to said transmission line;

signal input means, connected between said pair of terminals, for transforming a variation of current flowing between said pair of terminals into digital electrical signals; and signal output means, connected between said pair of terminals, for transforming current flowing between said pair of terminals in accordance with digital electrical signals, wherein said communicator monitors a status of said field instruments by communicating with said field instruments through said signal input means and said signal output means using digital electrical signals, wherein said communicator is detachably connected to said transmission line and has a DC-DC converter connected between said pair of terminals and has a constant current circuit for adjusting an output current of said DC-DC converter to a constant value, such that electric power drawn from said current loop is fed to said DC-DC converter, which then supplies the electric power to said communicator for consumption by said communicator, and wherein said communicator responds to said host instrument by communicating with said host instrument through said signal input means and said signal output means using digital electrical signals.

5. A field instrument system, comprising:

a plurality of field instruments for measuring a physical quantity respectively;

a host instrument;

a power source;

a transmission line which connects the field instruments, the host instrument and the power source in a current loop, wherein an electrical signal representing the measured physical quantity is transmitted from each one of the field instruments to the host instrument; and a communicator for monitoring the field instrument, wherein the electrical signal representing the measured physical quantity is a digital signal, wherein said communicator communicates with said field instruments and said host instrument using digital signals, and wherein said communicator includes means for deriving its electric power from the current loop and is freely connectable to or disconnectable from the transmission line without affecting communication of the digital signal transmitted thereon.

6. A field instrument system according to claim 5, wherein said communicator includes a constant current circuit for controlling the electric power derived from said current loop at a constant value, said constant current circuit being connected in parallel to said field instrument.

7. A field instrument system according to claim 5, wherein said communicator includes a constant current circuit for controlling the electric power derived from said current loop at a constant value, said constant current circuit being connected in parallel to said field instruments.

8. A field instrument system according to claim 5, wherein said communicator includes a constant current circuit for controlling the electric power derived from the current loop at a constant value, said constant current circuit being connected in parallel to a voltage drop element which is series connected in the current loop.

9. A field instrument system according to claim 5, wherein said communicator includes a constant current circuit for controlling the electric power derived from the current loop at a constant value, said constant current circuit being connected in parallel to a voltage drop element which is series connected in the current loop.

10. A communicator, comprising:

a pair of terminals to be attached to a transmission line which forms a current loop connecting a plurality of field instruments, a host instrument and a power source;

signal input means connected between said terminals for transforming a variation of the current flowing between the terminals into a first digital signal; and signal output means connected between said terminals for changing the current flowing between the terminals in accordance with a second digital signal, wherein said communicator communicates with said field instrument and said host instrument through said signal input means and said signal output means using digital signal so as to monitor said field instrument, wherein said communicator has a DC-DC converter connected to said pair of terminals to derive the electric power for operating said communicator from the current loop and a constant current circuit for adjusting the current drawn by the DC-DC converter from the current loop to a constant value, and wherein said communicator is freely connectable to or disconnectable from the transmission line without affecting communication over the transmission line of digital signals representing a physical quantity measured by the field instruments.

11. A communicator, comprising:

a pair of terminals to be attached to a transmission line which forms a current loop connecting a plurality of field instruments, a host instrument and a power source;

signal input means connected between said terminals for transforming a variation of a current flowing between the terminals into a first digital signal; and signal output means connected between said terminals for changing the current flowing between the terminals in accordance with a second digital signal, wherein said communicator communicates with said field instrument and said host instrument through the signal input means and the signal output means, using digital signals so as to monitor the field instrument, wherein said communicator has a DC-DC converter connected to the pair of terminals to derive the electric power for operating the communicator from the current loop, wherein said DC-DC converter includes means for maintaining the voltage across the pair of terminals constant while said electric power is drawn from the current loop, and wherein said communicator is freely connectable to or disconnectable from the transmission line without affecting communication over the transmission line of digital signals representing a physical quantity measured by the field instruments.

* * * * *